United States Patent [19]

Kaplan et al.

[11] Patent Number: 4,903,409

[45] Date of Patent: Feb. 27, 1990

[54] DRYWALL SCRIBING AND SCORING TOOL

[76] Inventors: Stuart N. Kaplan, 485 Front St. Apt. 221, Hempstead, N.Y. 11550; Frank Matassa, 1 Anchorage Way, Apt. 111, Freeport, N.Y. 11520

[21] Appl. No.: 354,900

[22] Filed: May 19, 1989

[51] Int. Cl.[4] ..... B26B 29/00

[52] U.S. Cl. ..... 30/293; 30/294; 33/42

[58] Field of Search ..... 30/289, 290, 293, 294; 83/614, 745; 33/32.1, 32.2, 41.1, 41.4, 42, 44

[56] References Cited

U.S. PATENT DOCUMENTS 1,577,569 3/1926 Donley ..... 33/41.1
2,090,183 8/1937 Capstick ..... 30/293
2,098,641 11/1937 Cook ..... 30/293
4,334,360 6/1982 Burns et al. ..... 33/42

*Primary Examiner*—Douglas D. Watts
*Attorney, Agent, or Firm*—Richard L. Miller

[57] ABSTRACT

A drywall scribing and scoring tool for a typical wallboard is provided in which a knife holding unit and scribe units can be adjusted along a scale on an elongated arm of a T-square member. When the short head portion of the T-square member is slid along one edge of the wall board by a person the tool will cut a score into the wall board for breaking to a predetermined size and mark center lines for wall stud nailing locations simultaneously upon the wall board allowing easy installation of the wall board to the wall studs.

5 Claims, 1 Drawing Sheet

DRYWALL SCRIBING AND SCORING TOOL

BACKGROUND OF THE INVENTION

The instant invention relates generally to cutting devices and more specifically it relates to a drywall scribing and scoring tool.

Numerous cutting devices have been provided in the prior art that are adapted to cut strips of thick sheet material For example, U.S. patents numbered 2,641,834 to Bobrowski; 4,195,406 to Lackey and 4,495,697 to Ruff all are illustrative of such prior art. While these units may be suitable for the particular purpose to which they address, they would not be as suitable for the purpose of the present invention as hereafter described.

SUMMARY OF THE INVENTION

A primary object of the present invention is to provide a drywall scribing and scoring tool that will overcome the shortcomings of the prior art devices.

Another object is to provide a drywall scribing and scoring tool which will mark wall stud locations and score for breaking a typical wall board to a predetermined size so that the wall board can be quickly nailed to the studs.

An additional object is to provide a drywall scribing and scoring tool in which the scribing units and knife holding unit can be adjusted along a scale on a T-square member for varying the spaces between the wall stud locations and size of the wall board.

A further object is to provide a drywall scribing and scoring tool that is simple and easy to use.

A still further object is to provide a drywall scribing and scoring tool that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 2:
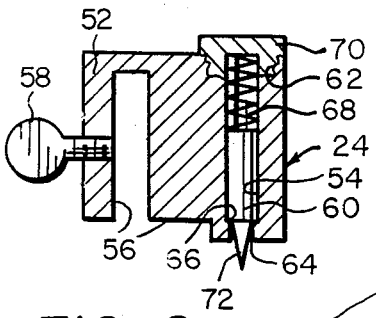
FIG. 2 is a side cross-sectional view taken on line 2—2 of FIG. 1 of the scribe unit shown removed from the rest of the invention.
Figure 1:
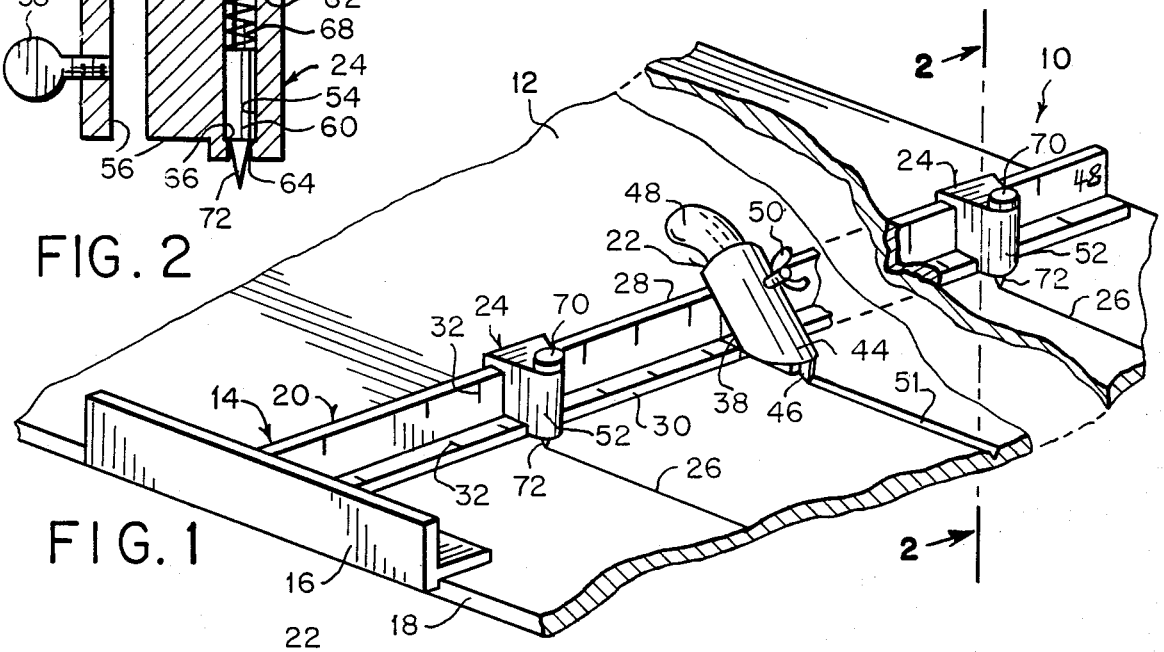
FIG. 1 is a diagrammatic fragmentary perspective view of the instant invention shown inoperative use cutting and scribing a typical wall board.
Figure 3:
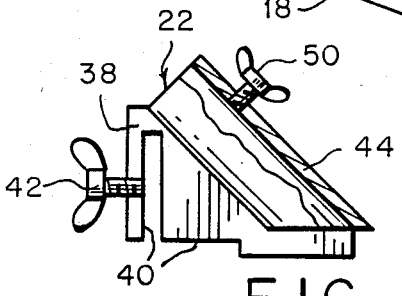
FIG. 3 is a side elevational view of the knife holding unit shown partly broken away and removed therefrom.
Figure 5:
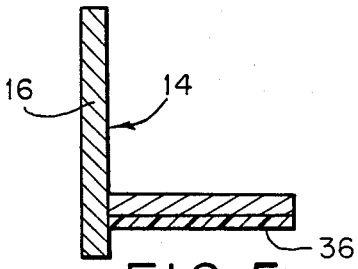
FIG. 5 is a cross sectional view taken along line 5—5 of FIG. 4.
Figure 4:
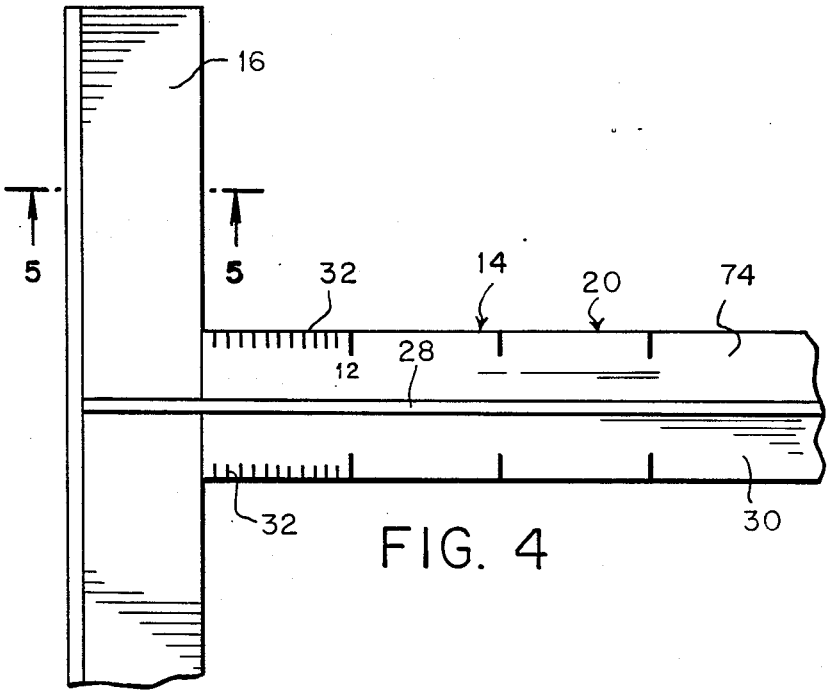
FIG. 4 is a fragmentary top plan view of the T-square member of the invention.
Figure 6:
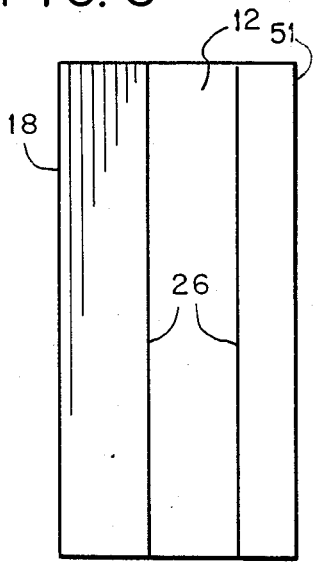
FIG. 6 is a plan view of a typical wall board after being marked and scored by the invention.

Turning now descriptively to the drawings, in which like reference characters denote like elements throughout the several views, the figures illustrate a drywall scribing and scoring tool 10 for a typical wall board 12 that consists of a T-square member 14 having a short head portion 16 which can bear against one edge 18 of the wall board 12 and an elongated arm portion 20 extending perpendicular from the short head portion 16.

A knife holding unit 22 is adjustably carried on the arm portion 20 for cutting into the wall board 12 parallel to the bearing edge 18 of the wall board 12 that the short head portion 16 slides against so that the wall board 12 can be scored an then broken along the score to a predetermined size.

A plurality of scribe units 24 are spaced apart and carried on the arm portion 20 for marking lines 26 on the the wall board 12 parallel to the bearing edge 18 of the wall board 12 that the short head portion 16 slides against so that center line of wall stud locations can be indicated when the wall board 12 is placed against the wall studs and nailed thereto.

The elongated arm portion 20 is of T-shaped configuration in cross section forming three legs 74, 28 and 30. A scale 32 is disposed upon the legs 74, 28 and 30 of the elongated arm portion 20 so that the knife holding unit 22 and scribe units 24 can be properly positioned thereupon. The elongated arm portion 20 and short head portion 16 can include an optional teflon bottom layer 36 to provide a better sliding surface upon the wall board 12.

The knife holding unit 22 includes a body member 38 that has a right angle cutout area 40 so that the body member 38 can slide upon the two right angle legs 28 and 30 of the elongated arm portion 20. A first clamp screw 42 is threaded horizontally into the body member 38 at the right angle cutout area 40 for locking the body member against the upright leg 32 of the elongated arm portion 20. A sleeve member 44 is secured angularly on the body member 38 for holding a blade 46 of a knife 48 therein. A second clamp screw 50 is threaded perpendicular into the sleeve member 40 for locking the knife 48 within the sleeve member 40 so that the blade 46 can cut into the wall board 12 at 51.

Each of the scribe units 24 includes a housing member 52 having a vertical chamber 54 and a right angle cut out area 56 so that the housing member 52 can slide upon the two right angle legs 28 and 30 of the elongated arm portion 20. A clamp screw 58 is threaded horizontally into the housing member 52 at the right angle cut out area 56 for locking the housing member 52 against the upright leg 28 of the elongated arm portion 20. A pencil 60 is installed within the chamber 54 in the housing member 52. The pencil 60 is biased downwardly within the chamber 54 so that the pencil 60 can produce one of the marking lines 26 on the wall board 12.

The vertical chamber 54 has an internally threaded upper aperture 62 and a reduced lower aperture 64 forming a seat 66 therein. A spring 68 is disposed within the vertical chamber 54 onto the pencil 60. A cap 70 having external threads is threaded into the internally threaded upper aperture 62 over the spring 68 so that the spring will cause the pencil 60 to bear against the seat 66 with pencil point 72 extending therefrom which will produce the marking line 26. The aperture 64 is sized accordingly small enough to prevent the pencil 60 from fitting entirely therethrough, but large enough to allow the pencil point 72 to reach the surface of a typical wall board 12 placed below for scribing.

To operate the tool 10 one person can simply slide and lock the knife holding unit 22 and scribe units 24 along the leg 28 of the elongated arm portion 20 at desired positions along the scale 32. The short head portion 16 can then be slid by one person along the bearing edge 18 of the wall board 12 to mark the wall stud locations and score for breaking or cut the wall board 12 to a predetermined size so that it can be quickly nailed to the wall studs by the person.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A drywall scribing and scoring tool for a typical wall board which comprises:

(a) a T-square member having a short head portion which can bear against one edge of the wall board and an elongated arm portion extending perpendicular from said short head portion;

(b) means adjustably carried on said arm portion, for cutting into the wall board parallel to the bearing edge of the wall board that said short head portion slides against so that said wall board can be cut to a predetermined size; and (c) means adjustably carried on said arm portion, for marking lines on the wall board parallel to the bearing edge of the wall board that said short head portion slides against so that wall stud locations can be indicated when the wall board is placed against the wall studs and nailed thereto.

2. A drywall scribing and scoring tool as recited in claim 1, further comprising:

(a) said elongated arm portion being a T-shaped configuration in cross section forming three legs; and (b) a scale printed on at least one of said legs of said elongated arm portion so that said cutting means and said marking means can be properly positioned thereupon.

3. A drywall scribing and scoring tool as recited in claim 2, wherein said cutting means includes:

(a) a body member having a right angle cut out area so that said body member can slide upon two right angle legs of said elongated arm portion;

(b) a first clamp screw threaded horizontally into said body member at said right angle cut out area for locking said body member against said upright leg of said elongated arm portion;

(c) a sleeve member secured angularly on said body member for holding a blade of a knife therein; and (d) a second clamp screw threaded perpendicular into said sleeve member for locking the knife within said sleeve member so that the blade can cut into the wall board.

4. A drywall scribing and scoring tool as recited in claim 3, wherein said marking means includes:

(a) at least one housing member having a vertical chamber and a right angle cut out area so that said housing member can be slid upon said two right angle legs of said elongated arm portion;

(b) a clamp screw, threaded horizontally into said housing member at said right angle cut out area for locking said housing member against said upright leg of said elongated arm portion;

(c) a pencil installed within said chamber in said housing member; and (d) means for biasing said pencil downwardly within said chamber so that said pencil can produce the marking lines on the wall board.

5. A drywall scribing and scoring tool as recited in claim 4, wherein said biasing means includes:

(a) said vertical chambers having an internally threaded upper aperture and a reduced lower aperture forming a seat therein;

(b) a spring, installed within said vertical chamber with said pencils; and (c) a cap, having external threads which is threaded into said internally threaded upper aperture over said spring so that said spring will biases said pencil to bear against said seat with pencil point extending therefrom, which will produce the marking line on a wall board places there beneath.

* * * * *